US007782310B2

(12) United States Patent
Wang

(10) Patent No.: US 7,782,310 B2
(45) Date of Patent: Aug. 24, 2010

(54) METHOD FOR DISPLAYING FRAME AND DISPLAY APPARATUS USING THE SAME

(75) Inventor: Chun-Lung Wang, Nantou County (TW)

(73) Assignee: Novatek Microelectronics Corp., Hsinchu (TW)

( * ) Notice: Subject to any disclaimer, the term of this patent is extended or adjusted under 35 U.S.C. 154(b) by 870 days.

(21) Appl. No.: 11/462,373

(22) Filed: Aug. 4, 2006

(65) Prior Publication Data

US 2007/0285416 A1 Dec. 13, 2007

(30) Foreign Application Priority Data

Jun. 13, 2006 (TW) ..... 95120927 A

(51) Int. Cl.
*G09G 5/00* (2006.01)

(52) U.S. Cl. ..... 345/204; 345/212; 345/213; 345/214

(58) Field of Classification Search ..... 345/213
See application file for complete search history.

(56) References Cited

FOREIGN PATENT DOCUMENTS

| | | | |
|---|---|---|---|
| JP | 07-310471 | * | 6/1997 |
| JP | 9-154086 | | 6/1997 |
| JP | 11-88794 | | 3/1999 |

OTHER PUBLICATIONS

Masanobu, JP07-310471, Jun. 1997, Japanese Patent Office.*

* cited by examiner

*Primary Examiner*—Amare Mengistu
*Assistant Examiner*—Joseph G Rodriguez
(74) *Attorney, Agent, or Firm*—Jianq Chyun IP Office

(57) ABSTRACT

A method for displaying frame and a display apparatus using the same, suitable for displaying a plurality of frame data in an image signal on a display panel, are provided. A vertical blank period is located between every two adjacent frame data in the image signal. The method for displaying frame includes the following steps. A background frame is displayed on the display panel during the vertical blank period of the image signal. One of the frame data is displayed on the display panel during the non-vertical blank period of the image signal.

11 Claims, 7 Drawing Sheets

METHOD FOR DISPLAYING FRAME AND DISPLAY APPARATUS USING THE SAME

CROSS-REFERENCE TO RELATED APPLICATION

This application claims the priority benefit of Taiwan application serial no. 95120927, filed Jun. 13, 2006. All disclosure of the Taiwan application is incorporated herein by reference.

BACKGROUND OF THE INVENTION

1. Field of Invention

The present invention relates to a display apparatus and a method for displaying frame. More particularly, the present invention relates to a display apparatus and a method for displaying frame, wherein a frame with a resolution different from that of the panel is displayed thereon.

2. Description of Related Art

Researches show that the natural visual field ratio of a human eye is 16:9, that is, the optimal ratio for the human eye to capture the "golden section line" of an image is 16:9. When viewing a scene with a horizontal viewing angle range close to 28~30°, the eye does not need to adjust the visual focus point on the image of the scene by force, and the frame can occupy the whole visual field naturally. When viewing a frame with an aspect ratio (i.e., picture ration) of 16:9, the visual range is about 27°, close to the natural focusing viewing angle range. When viewing a frame with an aspect ratio of 4:3 at the same distance, as the horizontal viewing angle is only 18°, the eyes will feel tired. A frame with an aspect ratio of 16:9 reduces the visual difference between a film and a display apparatus (for example, a liquid crystal display) to some extent, and the wide frame arouses a stronger present sensation when being viewed.

With the above advantages, the image signal with a play format of the aspect ratio of 16:9 will undoubtedly become the mainstream in the future. However, as the current TV programs mainly adopt an image signal with a play format of the aspect ratio of 4:3, display apparatuses with a screen aspect ratio of 4:3 are still the mainstream on the market. FIG. 1 is a schematic view of displaying a frame with a relatively low resolution on a display apparatus with a fixed resolution according to a conventional art. If a display apparatus with a screen aspect ratio of 4:3 is used to play a frame with an aspect ratio of 16:9 (similar to displaying a frame with a relatively low resolution on a display apparatus with a fixed resolution), generally the frame can only be constantly displayed on the upper part of the display apparatus, and the area of the display apparatus that does not display the frame cannot be controlled to display other background frames. Therefore, as the frame with an aspect ratio of 16:9 cannot be displayed in the center of the screen of the display apparatus, a frame as shown in FIG. 1 is seen.

Therefore, some manufacturers use a scaler in the display apparatus to display the frame with a relatively low resolution in the center of the panel with a high resolution. That is, in the conventional art, the scaler is used to store the complete original image data (with an aspect ratio of 16:9) into an inner storage memory. Next, according to the resolution of the display panel, the background data is added into the frame of image data to adjust the resolution. Then, the new image data (with an aspect ratio of 4:3) in conformity to the resolution of the panel is transmitted to a timing controller. Under the drive of the timing controller, a source driver and a gate driver, the scaler in the conventional art can make the frame with an aspect ratio of 16:9 displayed in the center of the display panel with an aspect ratio of 4:3.

Further, in other conventional arts, the architecture of the driving integrated circuit of the display apparatus is changed to make the image signal with a play format of the screen aspect ratio of 4:3 compatible with the image signal with a play format of the screen aspect ratio of 16:9 in the display apparatus, such that the display apparatus with a screen aspect ratio of 4:3 can play the image with an aspect ratio of 16:9 in the center, as shown in FIG. 2. FIG. 2 is a schematic view of displaying a frame with a relatively low resolution in the center of a display apparatus with a fixed resolution.

However, as the profit of electronic products is getting smaller while the haggling competition thereof becomes fiercer, the above-mentioned manner increases the fabricating cost of the display apparatus, thereby affecting the gain space of the manufacturers. Moreover, the architecture of the driving integrated circuit is changed with great efforts, so as to make two aspect ratio play formats compatible with each other in the display apparatus, thus making the design of the display apparatus more difficult. Therefore, the aforementioned manner is not a wise option.

SUMMARY OF THE INVENTION

Accordingly, an objective of the present invention is to provide a method for displaying frame without using a large number of storage memories and/or changing the architecture of the driving integrated circuit in the display apparatus, such that a frame with a resolution different from that of the panel is displayed in the center of the display panel.

Another objective of the present invention is to provide a display apparatus. The display apparatus only needs to adjust the timing control of the timing controller to make the frame displayed in the center of the display panel without using storage memories and/or changing the architecture of the driving integrated circuit in the display apparatus.

Based on the above and other objectives, the present invention provides a method for displaying frame, which is suitable for displaying a plurality of frame data in the image signal on the display panel. A vertical blank period is located between every two adjacent frame data in the image signal. The method for displaying frame comprises: displaying a background frame on the display panel during the vertical blank period of the image signal; and displaying one of the frame data on the display panel during the non-vertical blank period of the image signal.

Based on the above and other objectives, the present invention provides a display apparatus. The display apparatus comprises a display panel, a source driver, a gate driver, a processing unit and a timing controller. The source driver and the gate driver are coupled to the display panel. The processing unit is used to provide an image signal. The image signal comprises a plurality of frame data, and a vertical blank period is located between every two adjacent frame data. The timing controller is coupled to the processing unit, the source driver and the gate driver for receiving the image signal and driving the display panel by controlling the source driver and the gate driver, such that the display panel displays the background frame during the vertical blank period of the image signal, and the display panel displays one of the frame data during the non-vertical blank period of the image signal.

According to an embodiment of the present invention, the step of displaying the background frame on the display panel during the vertical blank period of the image signal comprises determining the quantity of a plurality of clock pulses. During the vertical blank period, the clock pulses are added into a gate clock, wherein the gate clock is used to provide the timing required by the gate driver of the display panel to drive the gate line. During the vertical blank period, a gate start pulse is provided to the gate driver of the display panel. The data of the background frame is added after each frame data of the image signal. The source driver of the display panel is used to latch the data of the background frame. The background frame is then displayed on the display panel according to the data of the background frame latched in the source driver.

According to an embodiment of the present invention, the above step of providing the gate start pulse to the gate driver of the display panel comprises: making the gate start pulse in an enable state during the first pulse of the clock pulses added in the vertical blank period.

According to an embodiment of the present invention, the above step of determining the quantity of the clock pluses comprises: calculating the difference between the number of the horizontal lines of the frame data and the number of the gate lines of the display panel, and dividing the result by 2, thus obtaining the quantitative value of the clock pulses.

In another embodiment, the step of determining the quantity of the clock pluses comprises: calculating the difference between the number of the horizontal lines of the frame data and the number of the gate lines of the display panel, and dividing the result by 2, thus obtaining a first numerical value. The first numerical value is added with a predetermined value to serve as the quantitative value of the clock pulses.

As the present invention is featured in that the image signal received by the display apparatus has a plurality of frame data and a vertical blank period is located between every two adjacent frame data, the background frame is displayed on the display panel during the vertical blank period of the image signal, and one of the frame data is displayed on the display panel during the non-vertical blank period of the image signal. Therefore, the present invention can display the frame in the center of the display panel or even at any position without using storage memories and/or changing the architecture of the driving integrated circuit in the display apparatus, only by changing the timing of the signal from the display apparatus for controlling the gate driver. Meanwhile, the present invention can reduce the fabricating cost, increase the gain space for the manufacturers and lower down the difficulty of designing the display apparatus.

In order to make the aforementioned and other objectives, features and advantages of the present invention comprehensible, preferred embodiments accompanied with figures are described in detail below.

DESCRIPTION OF EMBODIMENTS

Figure 1:
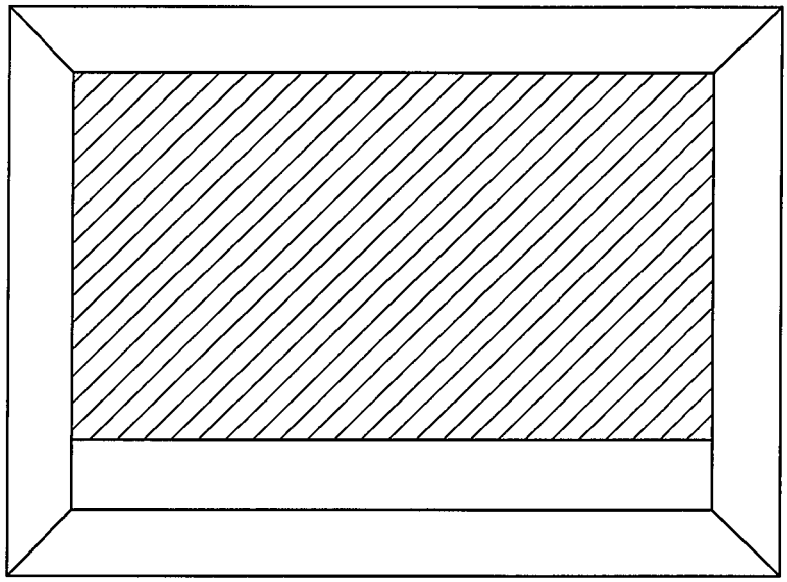
FIG. 1 (PRIOR ART)
FIG. 1 is a schematic view of displaying the frame with a relatively low resolution on the display apparatus with a fixed resolution in the conventional art.
Figure 2:
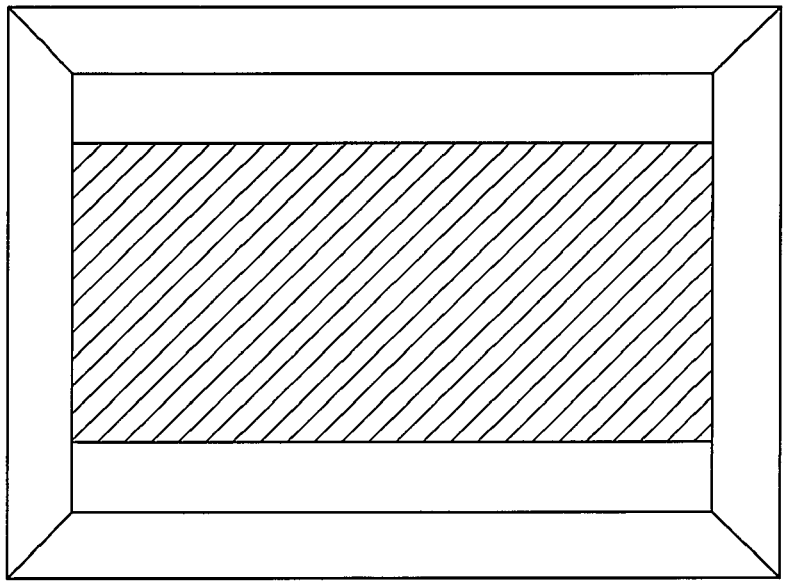
FIG. 2 is a schematic view of displaying the frame with a relatively low resolution in the center of the display apparatus with a fixed resolution.
Figure 3:
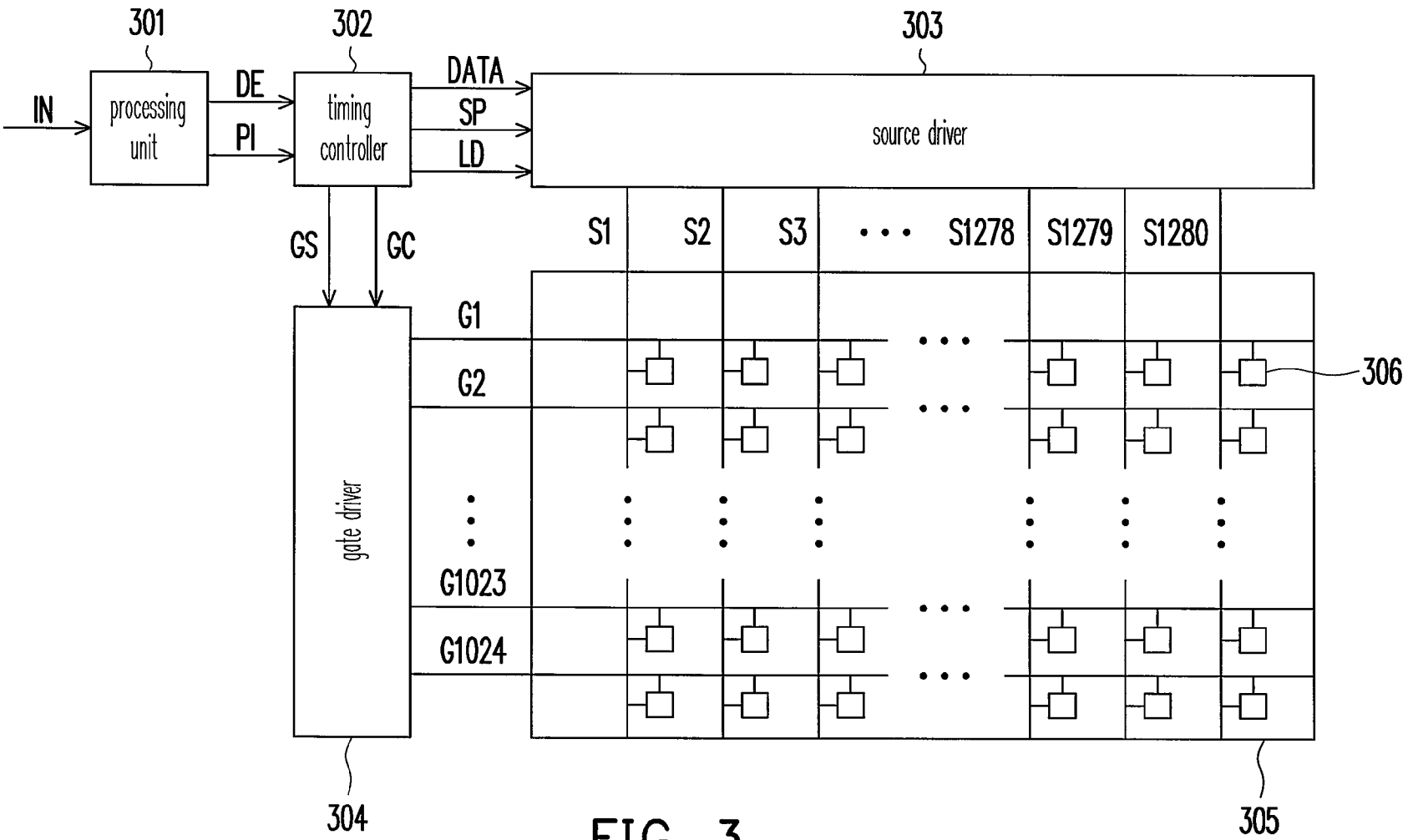
FIG. 3 is a circuit diagram of the display apparatus of the present invention.
Figure 9:
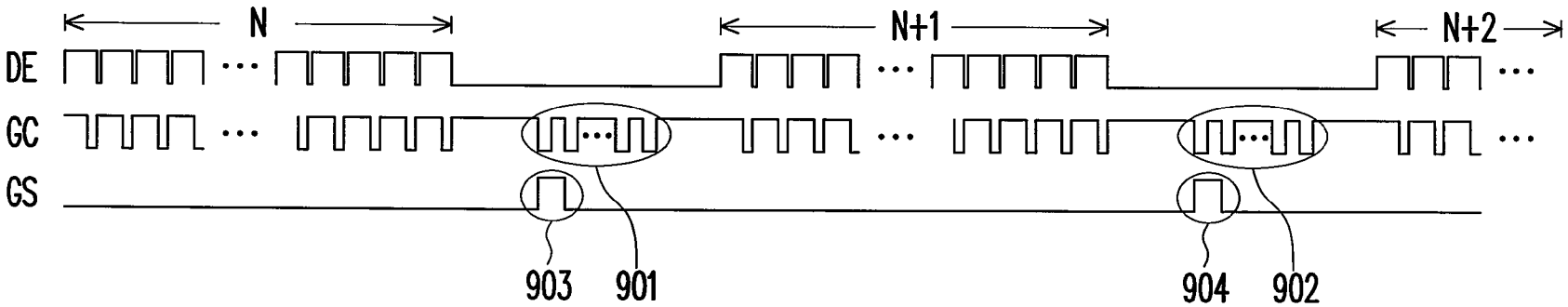
FIGS. 9 and 10 are signal timing charts of the method for displaying frame according to the present invention.
Figure 10:
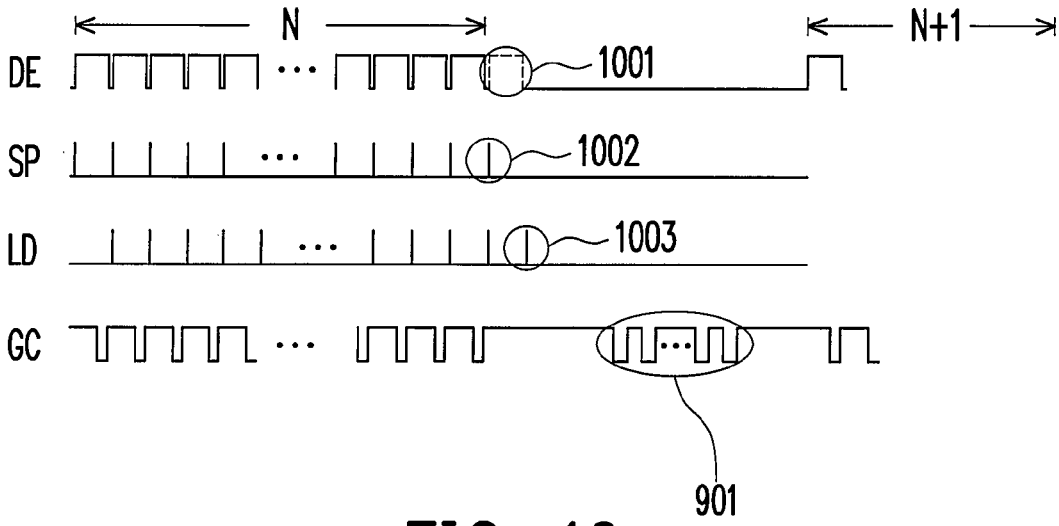

For easy illustration, in the following embodiments, it is assumed that the resolution of the original frame data is 1280×900, and the resolution of the display panel in the display apparatus (for example, liquid crystal display) is 1280×1024. Moreover, in the following embodiments, displaying the frame in the center of the display panel is used as an example for illustrating the operating manner of the present invention. In the following embodiments, FIG. 3 is a circuit diagram of the display apparatus according to the present invention. FIGS. 4, 5, 6, 7 and 8 are flow charts of the method for displaying frame according to the present invention. FIG. 9 and FIG. 10 are signal timing charts of the method for displaying frame according to the present invention. Please refer to each figure according to the illustration.

In FIG. 3, 301, 302, 303, 304, 305 are respectively a processing unit, a timing controller, a source driver, a gate driver and a display panel. In the embodiment, the processing unit 301 may comprise a scaler. The display panel 305 has gate lines G1~G1024 and source lines S1~S1280. The gate lines G1~G1024 are respectively driven by the gate driver 304, and the source lines S1~S1280 are respectively driven by the source driver 303. A sub-pixel is disposed at every junction of the gate lines and the source lines (for example, a sub-pixel 306). The processing unit 301 receives an input signal IN, so as to provide an image signal PI. The image signal PI comprises a plurality of frame data, and a vertical blank period is located between every two adjacent frame data.

Figure 4:
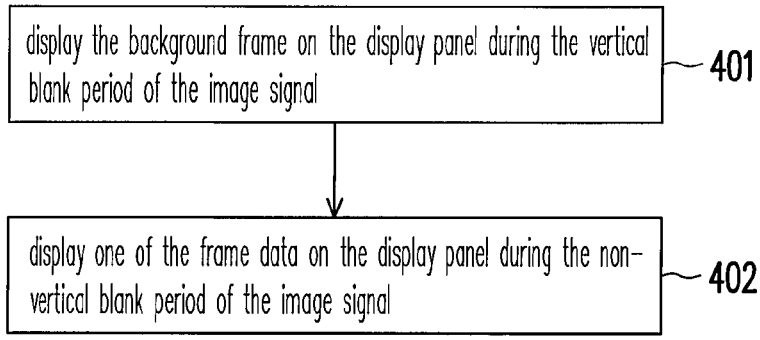
FIGS. 4, 5, 6, 7 and 8 are flow charts of the method for displaying frame according to the present invention.

Referring to FIG. 3 and FIG. 4, as the number of the horizontal lines (i.e., the vertical resolution) of each frame data in the image signal PI is 900, and the number of the gate lines G1~G1024 (i.e., the vertical resolution of the display apparatus) is 1024, if the frame data is to be displayed in the center of the display apparatus, the part of the display apparatus that does not display the frame data must display the background frame (or display no frame data at all). The timing controller 302 is used to receive the image signal PI output by the processing unit 301, and the timing controller 302 drives the display panel 305 by controlling the source driver 303 and the gate driver 304, so as to make the display panel 305 display the background frame during the vertical blank period of the image signal PI (Step 401 in FIG. 4). That is, during the vertical blank period, the part of the gate line area on the display panel 305 of the display apparatus that does not display the frame data is made to display the background frame. Then, during the non-vertical blank period of the image signal PI, the display panel 305 is made to display one of the frame data (Step 402 in FIG. 4).

Figure 5:
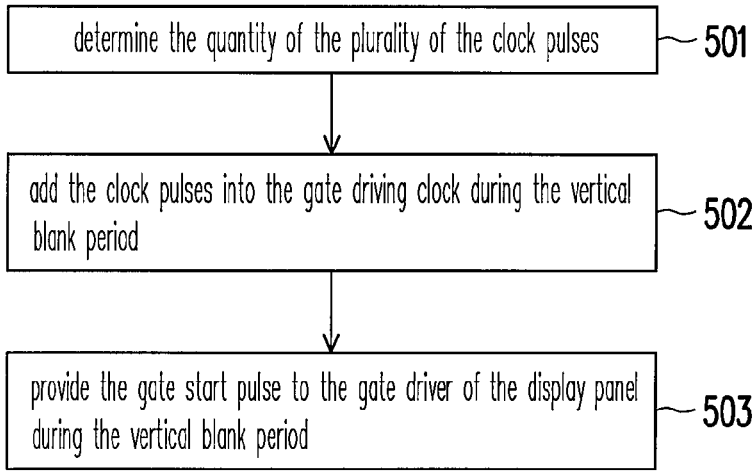

FIG. 5 is an embodiment illustrating Step 401 in FIG. 4 according to the present invention. FIG. 9 is a signal timing chart after each step in FIG. 5 according to the embodiment of the present invention. Referring to FIGS. 3, 5 and 9, the timing controller 302 outputs a gate clock GC and an gate start pulse GS to the gate driver 304, so as to make the gate driver 304 drive the gate lines G1~G1024 of the display panel 305 according to the timing of the gate clock GC and the gate start pulse GS. The timing controller 302 further carries out the following operations. First, the timing controller 302 needs to determine the quantity of a plurality of clock pulses (Step 501 in FIG. 5). The exemplary embodiment of Step 501 is described hereinafter. In the vertical blank period, the timing controller 302 adds the clock pulses with the quantity determined by Step 501 into the gate clock GC (Step 502 in FIG. 5). For example, it is shown in FIG. 9 that during the vertical blank period between adjacent frame data periods N and N+1, clock pulses 901 with the quantity determined by Step 501 are added into the gate clock GC; further, during the vertical blank period between adjacent frame data periods N+1 and N+2, clock pulses 902 with the quantity determined by Step 501 are added into the gate clock GC. During the vertical blank period, the timing controller 302 outputs the gate start pulse GS and the gate clock GC to the gate driver 304 (Step 503 in FIG. 5). As such, the timing controller 302 drives the gate lines by controlling the gate driver 304, so as to make the display panel 305 display the background frame during the vertical blank period of the image signal PI.

Furthermore, in FIG. 9, DE is a data enable signal output by the processing unit 301 to the timing controller 302. The timing controller 302 receives each frame data in the image signal PI in sequence according to the timing of the data enable signal DE. N, N+1 and N+2 respectively indicate the $N_{th}$, the $(N+1)_{th}$ and the $(N+2)_{th}$ frame data. As described above, in the present embodiment, it is assumed that each frame data in the image signal PI respectively has 900 horizontal line data, and thus during each frame data period (non-vertical blank period), the quantity of the pulses of the data enable signal DE is 900. In the present embodiment, during each frame data period, the gate clock GC output by the timing controller 302 also has 900 pulses. In the present embodiment, during the first pulse in the clock pulses (for example, the clock pulses 901 or 902) added in the vertical blank period, the timing controller 302 makes the gate start pulse GS in an enable state (for example, the pulse 903 or 904). However, the user can also change the enable time of the gate start pulse GS according to practical demands on design.

Figure 11:
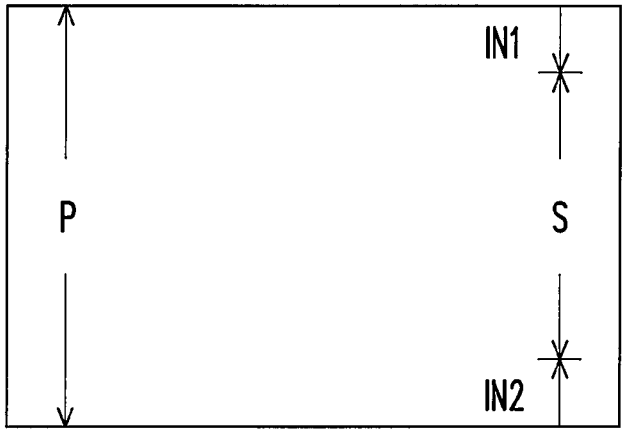
FIG. 11 is a schematic view of calculating the quantity of the plurality of the clock pulses according to an embodiment of the present invention.

The aforementioned manner of determining the quantity of the plurality of clock pulses by the timing controller 302 is illustrated by FIG. 11. FIG. 11 is a schematic view of calculating the quantity of the plurality of the clock pulses according to an embodiment of the present invention. Referring to FIGS. 3 and 11, in FIG. 11, P indicates the number of the gate lines of the display panel 305 in the display apparatus (1024 in the present embodiment), S indicates the number of the horizontal lines of each frame data in the image signal PI (900 in the present embodiment), and IN1 and IN2 indicate the number of the gate lines of the part of the display panel 305 of the display apparatus that does not display the frame data (the background part). For the present embodiment, as the frame is to be displayed in the center of the display panel 305 of the display apparatus, the numbers of the gate lines IN1 and IN2 are the same. Therefore, the timing controller 302 calculates the difference between the number of the gate lines of the display panel P and the number of the horizontal lines of the frame data S, and divides the result by 2, that is, the value of (P−S)/2 is taken as the quantitative value of the clock pulses. The quantitative value is the number of the gate lines IN1 and IN2 in the present embodiment, thereby acquiring that IN1 and IN2 are respectively 62 gate lines.

Referring to FIGS. 3, 9 and 11, according to the above manner, before the enable pulse of the $(N+1)_{th}$ frame data starts operating (i.e., during the vertical blank period), the timing controller 302 outputs the pulse 903 in the gate start pulse GS to the gate driver 304. When the pulse 903 is output to the gate driver 304, the timing controller 302 also starts outputting the pulses 901 to the gate driver 304, such that the gate driver 304 begins to drive gate lines G1~G62 sequentially according to the timing of the added clock pulses 901, and all together 62 gate lines are driven. Next, when the processing unit 301 transmits the frame data to the timing controller 302, that is, when the enable pulse of the $(N+1)_{th}$ frame data starts operating, the gate driver 304 drives gate lines G63~G962 sequentially according to the timing of the gate clock GC, and all together 900 gate lines are driven. After that, the gate driver 304 drives gate lines G963~G1024 according to the clock pulses 902 output by the timing controller 302, and all together 62 gate lines are driven. The above manner of driving the gate lines can make the frame displayed in the center of the display apparatus.

However, in the embodiment, during the first pulse in the clock pulses 902 added during the vertical blank period, the timing controller 302 makes the gate start pulse GS in an enable state (pulse 904 herein). Therefore, when the timing controller 302 outputs the clock pulses 902, the gate driver 304 drives the gate lines G963~G1024 in sequence, and meanwhile drives the gate lines G1~G62. As such, the gate lines G963~G1024 and the gate lines G1~G62 can be driven by the gate driver 304 in the same period. The purpose is to reduce the total number of the clock pulses added during the vertical blank period, such that it is unlikely that the gate driver 304 overlaps the original clocks (for example, the gate clock of the $N_{th}$ frame data or the gate clock of the $(N+1)_{th}$ frame data) and thus cause disorder on logic as the added clock pulses (for example, the pulses 901) are excessive.

Figure 8:
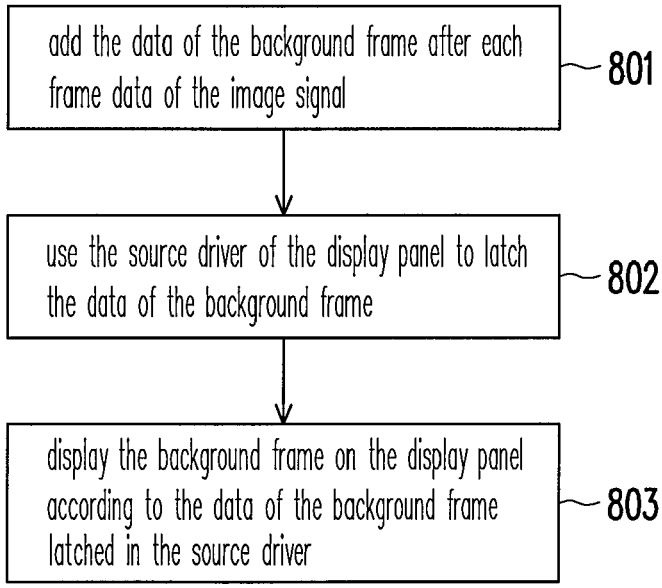

FIG. 8 is a flow chart of the steps of driving the source in response to Step 401 in FIG. 4 according to an embodiment of the present invention. FIG. 10 is a signal timing chart after each step in FIG. 8 according to an embodiment of the present invention. Referring to FIGS. 3, 8 and 10, as in the present embodiment, it is intended that the part of the display apparatus that does not display the frame data displays the background frame, the processing unit 301 has to add the data of the background frame after each frame data of the image signal PI (Step 801 in FIG. 8), and transmit the image signal PI added with the background frame data to the timing controller 302. In response to the added background frame data, the processing unit 301 adds an additional pulse (for example, a pulse 1001 in FIG. 10) after the output data enable signal DE. In order to make the source driver 303 latch the last horizontal line data of the frame data output by the processing unit 301 (i.e., the added background frame data), the timing controller 302 respectively adds a pulse into an output source start pulse SP and a source load signal LD according to the timing of the pulse 1001, as shown by a pulse 1002 and pulse 1003 in FIG. 10. According to the timing control of the source start pulse SP and the source load signal LD, the source driver 303 can correctly latch each source data in the background frame data into the corresponding data channel according to the additional pulse 1002 (Step 802 in FIG. 8).

Then, the source driver 303 outputs each source data (i.e., the data of the background frame) latched in the data channel to the display panel 305 according to the timing of the pulse 1003. The data of the background frame output by the source driver 303 is kept till another pulse occurs in the source load signal LD, and then the output of the source driver 303 is updated. After the source driver 303 latches and starts outputting the data of the background frame, the process enters the vertical blank period. During the vertical blank period, based on the above operation, the gate driver 304 drives the gate lines G1~G62 and the gate lines G963~G1024 sequentially according to the timing of the clock pulses 901. As such, the display panel 305 of the display apparatus displays the background frame according to the data of the background frame latched in the source driver 303 (Step 803 of FIG. 8), such that the part of the display apparatus that does not display the frame data displays the background frame. However, the user may determine whether to perform Steps 801~803 according to practical requirements. For example, the timing controller 302 may control the source driver 303, such that the source driver 303 does not output any data during the vertical blank period (for example, the output level thereof is made to be equal to the common voltage level of the display panel 305). Such a variation of the implementing manner can also achieve the function of the present embodiment.

Figure 6:
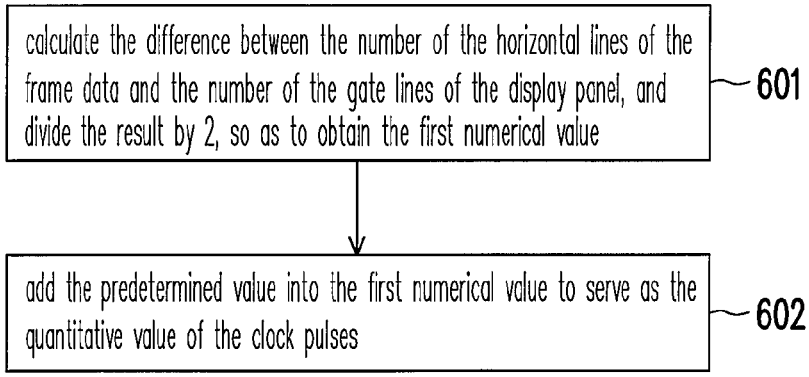

According to the spirit of the present invention, the position relationship between the frame to be displayed and the display panel is determined according to requirements. Therefore, the manner of determining the quantity of the plurality of the clock pulses by the timing controller 302 is described in FIG. 6. FIG. 6 is a flow chart of the sub-steps of Step 501 in FIG. 5 according to an embodiment of the present invention. Referring to FIGS. 3, 6 and 9, in other embodiments, if the user intends to display the frame data at a lower center position of the display apparatus, the timing controller 302 only needs to calculate the difference between the number of the gate lines P of the display panel 305 and the number of the horizontal lines S of the frame data, and divide the result by 2, so as to obtain the first numerical value (Step 601 in FIG. 6). Then, a predetermined value X is added into the first numerical value, i.e., (P−S)/2+X, so as to serve as the quantitative value of the clock pulses (Step 602 in FIG. 6). Next, during the vertical blank period, the timing controller 302 adds (P−S)/2+X clock pulses into the gate clock GC. For example, according to the assumption of the last embodiment, the predetermined value X (it is assumed that X=10) is added into the first numerical value (P−S)/2, i.e., (1024−900)/2+10, the quantitative value of the added clock pulses is 72. Therefore, the gate driver 304 may first drive the gate lines G1~G72 and the gate lines G973~G1024 during the vertical blank period. As such, when the vertical blank period ends and the data enable signal DE starts operating, the gate driver 304 drives gate lines G73~G972 according to the gate clock GC. According to the above manner of driving the gate lines, the frame can be displayed at a lower center position of the display apparatus.

Figure 7:
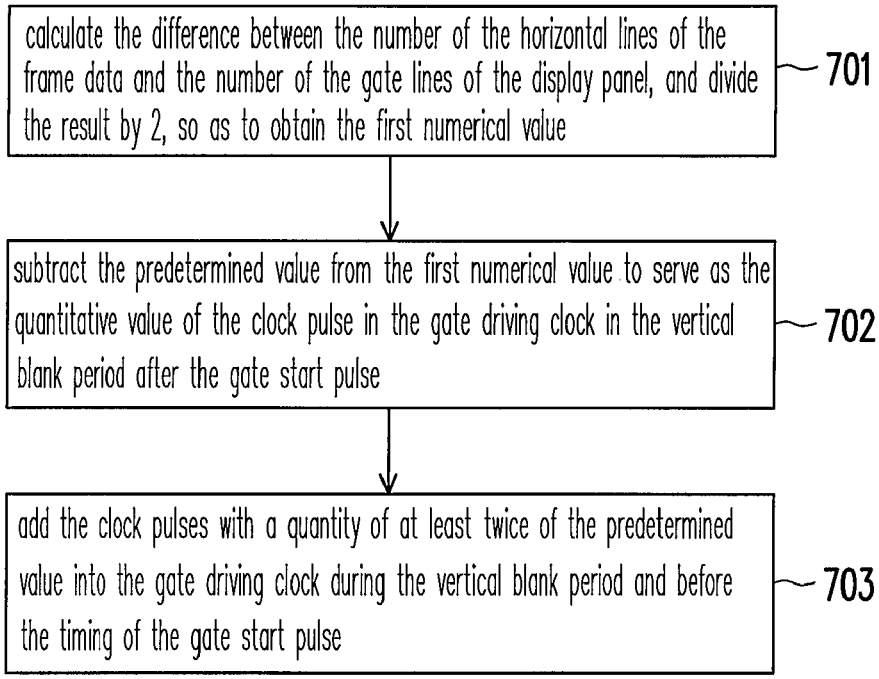
Figure 12:
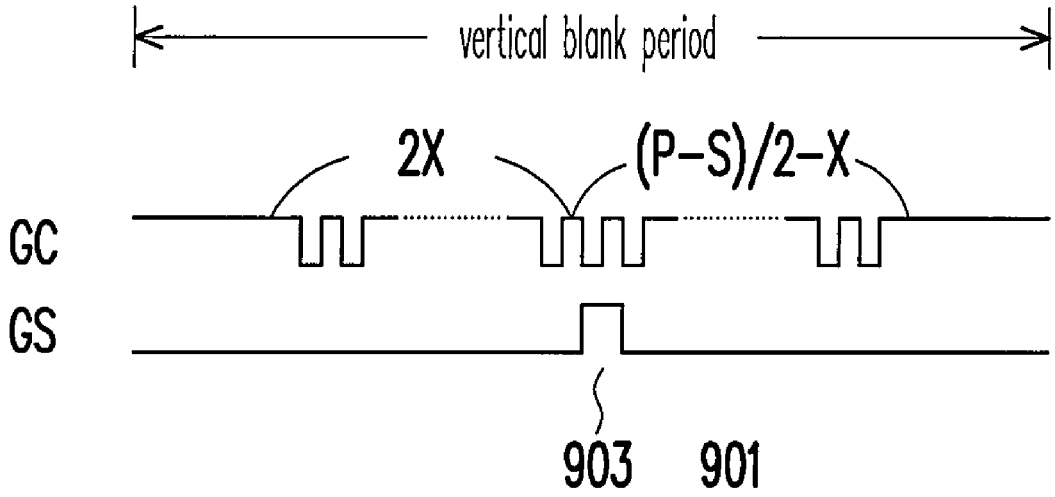
FIG. 12 is a timing chart of the gate start pulse GS and the gate clock GC in FIG. 3 during the vertical blank period according to another embodiment of the present invention.

FIG. 7 is a flow chart of the sub-steps of Step 501 in FIG. 5 according to another embodiment of the present invention. FIG. 12 is a timing chart of the gate start pulse GS and the gate clock GC in FIG. 3 during the vertical blank period according to another embodiment of the present invention. Referring to FIGS. 3, 7 and 12, similarly, if the user intends to make the frame data displayed at a lower center position of the display apparatus, only the timing controller 302 is used to calculate the difference between the number of the gate lines P of the display panel and the number of the horizontal lines S of the frame data, and divide the result by 2, so as to obtain the first numerical value (Step 701 in FIG. 7). Then, a predetermined value X is subtracted from the first numerical value, i.e., (P−S)/2−X, so as to serve as the quantitative value of the clock pulses in the gate clock GC during the vertical blank period after the gate start pulse GS (Step 702 in FIG. 7). In order to prevent the frame to be displayed overlapping the background frame, during the vertical blank period and before the timing of the gate start pulse GS, at least 2× clock pulses are added into the gate clock GC (Step 703 in FIG. 7), as shown in FIG. 12. Other parts of the present embodiment that are not mentioned can refer to the above embodiments, so they will not be described in detail herein. It should be noted that in all the embodiments, the added or subtracted predetermined value must be a natural number.

In view of the above, it is the spirit of the present invention that during the vertical blank period of the image signal PI, a plurality of clocks is added into the gate clock to make the gate driver drive the gate lines of a number corresponding to the number of the clocks, such that the frame is displayed at a designated position of the display apparatus. Therefore, the present invention is not limited to the above-mentioned embodiments.

As the present invention is featured in that the image signal PI received by the display apparatus has a plurality of frame data and a vertical blank period is located between every two adjacent frame data, the background frame is displayed on the display panel during the vertical blank period of the image signal PI, and one of the frame data is displayed on the display panel during the non-vertical blank period of the image signal PI. Therefore, the present invention can display the frame in the center of the display panel, or even at any position, without using storage memories and/or changing the architecture of the driving integrated circuit in the display apparatus, but only by changing the timing of the signal from the display apparatus for controlling the gate driver. Meanwhile, the present invention can reduce the fabricating cost, increase the gain space for the manufacturers and lower down the difficulty in designing the display apparatus.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A method for displaying frame, suitable for displaying a plurality of frame data in an image signal on a display panel, wherein a vertical blank period is located between every two adjacent frame data in the image signal, the method for displaying frame comprising:

displaying a background frame on the display panel during the vertical blank period of the image signal; and displaying one of the frame data on the display panel during the non-vertical blank period of the image signal, wherein the step of displaying the background frame on the display panel during the vertical blank period of the image signal comprises:

determining the quantity of a plurality of clock pulses;

adding the clock pulses into a gate clock during the vertical blank period, wherein the gate clock is used to provide the timing required by the gate driver of the display panel to drive gate lines; and providing a gate start pulse to the gate driver of the display panel during the vertical blank period;

wherein the step of determining the quantity of the clock pulses comprises:

calculating the difference between the number of the gate lines of the display panel and the number of the horizontal lines of the frame data, and dividing the result by 2, so as to obtain a first numerical value;

subtracting a predetermined value from the first numerical value, to serve as the quantitative value of the clock pulses in the gate clock during the vertical blank period after the gate start pulse; and adding the clock pulses with a quantity of at least twice of the predetermined value into the gate clock during the vertical blank period and before the timing of the gate start pulse.

2. The method for displaying frame as claimed in claim 1, wherein the step of providing the gate start pulse to the gate driver of the display panel comprises:

making the gate start pulse in an enable state during the first pulse of the clock pulses added during the vertical blank period.

3. The method for displaying frame as claimed in claim 1, wherein the step of determining the quantity of the clock pluses comprises:

calculating the difference between the number of the gate lines of the display panel and the number of the horizontal lines of the frame data, and dividing the result by 2, so as to obtain the quantitative value of the clock pulses.

4. The method for displaying frame as claimed in claim 1, wherein the step of determining the quantity of the clock pluses comprises:

calculating the difference between the number of the gate lines of the display panel and the number of the horizontal lines of the frame data, and dividing the result by 2, so as to obtain a first numerical value; and adding a predetermined value into the first numerical value, to serve as the quantitative value of the clock pulses.

5. The method for displaying frame as claimed in claim 1, further comprising:

adding the data of the background frame after each frame data of the image signal;

using the source driver of the display panel to latch the data of the background frame; and displaying the background frame on the display panel according to the data of the background frame latched in the source driver.

6. A display apparatus, comprising:

a display panel;

a source driver, coupled to the display panel;

a gate driver, coupled to the display panel;

a processing unit, for providing an image signal, wherein the image signal comprises a plurality of frame data, and a vertical blank period is located between every two adjacent frame data;

a timing controller, coupled to the processing unit, the source driver and the gate driver for receiving the image signal and controlling the source driver and the gate driver to drive the display panel to display a background frame on the display panel during the vertical blank period of the image signal, and to display one of the frame data on the display panel during the non-vertical blank period of the image signal; outputting a gate clock and a gate start pulse to the gate driver, so as to make the gate driver drive the gate lines of the display panel according to the timing of the gate clock and the gate start pulse; determining the quantity of a plurality of clock pulses and adding the clock pulses into the gate clock during the vertical blank period; and outputting the gate start pulse to the gate driver during the vertical blank period; calculating the difference between the number of the gate lines of the display panel and the number of the horizontal lines of the frame data, dividing the result by 2, and then subtracting a predetermined value, to serve as the quantitative value of the clock pulses in the gate clock during the vertical blank period after the gate start pulse; adding clock pulses with a quantity of at least twice of the predetermined value into the gate clock during the vertical blank period and before the timing of the gate start pulse.

7. The display apparatus as claimed in claim 6, wherein the timing controller makes the gate start pulse at the enable state during the first pulse in the added clock pulses during the vertical blank period.

8. The display apparatus as claimed in claim 6, wherein the timing controller further calculates the difference between the number of the gate lines of the display panel and the number of the horizontal lines of the frame data, and divides the result by 2, to serve as the quantitative value of the clock pulses.

9. The display apparatus as claimed in claim 6, wherein the timing controller further calculates the difference between the number of the gate lines of the display panel and the number of the horizontal lines of the frame data, divides the result by 2, and then adds a predetermined value, to serve as the quantitative value of the clock pulses.

10. The display apparatus as claimed in claim 6, wherein the timing controller further adds the data of the background frame after each frame data of the image signal, and controls the source driver to latch the data of the background frame.

11. The display apparatus as claimed in claim 10, wherein during the vertical blank period, the timing controller further controls the source driver and the gate driver to drive the display panel, such that the display panel displays the background frame according to the data of the background frame latched in the source driver.

* * * * *